United States Patent [19]

O'Connor

[11] Patent Number: 4,614,344

[45] Date of Patent: Sep. 30, 1986

[54] INTERCHANGEABLE GAME BOARD

[76] Inventor: Patrick G. O'Connor, P.O. Box 7476, F. D. R. Station, New York, N.Y. 10150

[21] Appl. No.: 405,508

[22] Filed: Aug. 5, 1982

[51] Int. Cl.[4] ..... A63F 3/00

[52] U.S. Cl. ..... 273/283; 273/284; 273/153 R

[58] Field of Search ..... 273/283, 284, 287, 275, 273/153 R

[56] References Cited

U.S. PATENT DOCUMENTS

| | | | |
|---|---|---|---|
| 1,165,688 | 12/1915 | Maris | 273/283 X |
| 2,703,713 | 3/1955 | Moyer | 273/283 |
| 3,206,887 | 9/1965 | Eyler et al. | 273/284 X |
| 3,309,092 | 3/1967 | Hardesty et al. | 273/248 |
| 3,610,626 | 10/1971 | Nolte | 273/283 X |
| 4,093,236 | 6/1978 | Hoffa | 273/255 |
| 4,180,271 | 12/1979 | McMurchie | 273/275 |
| 4,225,137 | 9/1980 | Hebner | 273/241 |
| 4,331,333 | 5/1982 | Willcocks | 273/238 |
| 4,341,386 | 7/1982 | Kleva | 273/284 X |
| 4,465,283 | 8/1984 | Pilette et al. | 273/249 |

FOREIGN PATENT DOCUMENTS

| | | | |
|---|---|---|---|
| 801435 | 1/1951 | Fed. Rep. of Germany | 273/284 |
| 694880 | 7/1953 | United Kingdom | 273/284 |

OTHER PUBLICATIONS

"Cosmic Encounter", *Games Magazine*, p. 43, 11-1981, copy found in examiner search room A.U. 334.

*Primary Examiner*—Richard C. Pinkham
*Assistant Examiner*—Benjamin Layno

[57] ABSTRACT

A game board is composed of interchangeable congruent game board segments butted together randomly. The game board has an overall pathway design that differs with each arrangement of the congruent game board segments, in an infinite number of arrangements of the game board segments, each resulting in a unique overall pathway design. The geometric shape of the congruent game board segments of one particular embodiment of the invention is square, but other geometric shapes may also be used if all the game board segments of a particular set are congruent, all sides of all the game board segments are of equal length, and all interior angles of all the game board segments are equal in arc measurement. These stipulations ensure interchangeability regardless of the orientation of the various game board segments. Equilateral triangle and regular hexagons could be used. The pathway designs on the various congruent game board segments may be different for the several segments of a given set. However, entry/exit points of all the game board segments are at the same spaced locations on all sides of the game board segments. Thus, these entry/exit points align so that any side of any game board may be butted to any side of any other game board segment, permitting larger board playing areas and complex pathway designs on which the same game rules may apply.

11 Claims, 4 Drawing Figures

INTERCHANGEABLE GAME BOARD

BACKGROUND OF THE INVENTION

While the invention is subject to a wide range of applications, it is especially suited to be used as a gaming device and will be particularly described in that connection.

Game devices employing game boards utilizing a network of pathways, such as a labyrinth, as their main point of intrigue and puzzlement have been limited by the sameness of the unchanging and unchangeable network of pathways from one playing of a particular game to the next, as well as during the play of each particular game. Once the secrets and intricacies of an unchanging and unchangeable network of pathways are learned and mastered, the creative and entertaining challenge of the game ceases to exist.

In order to provide a game board that utilizes a network of pathways as its main point of intrigue and puzzlement and yet whose network of pathways may be unique for any and all games played, this game board, composed of congruent and totally interchangeable game board segments, has been invented.

Now, game devices employing game boards composed of game board segments are known. However, these segments often times are not congruent nor totally interchangeable. Usually they are to be fitted together in a predetermined way, or at least in a limited number of combinations. Their purpose is not to provide a game board whose network of pathways is unique for each particular arrangement of game board segments.

It is an object of the present invention to provide a game board device, whereby the game board is composed of congruent game board segments that may be butted together in seemingly countless combinations and arrangements, each resulting in a game board playing area with a unique overall pathway design.

It is a further object of the present invention to provide game board segments having all the sides of all the game board segments equal in length, such as square, equilateral triangular, or regular hexagonal geometric shapes.

It is a further object of the present invention to provide congruent game board segments having all interior angles of all game board segments equal in arc measurement, such as square, equilateral triangular, or regular hexagonal geometric shapes.

It is a further object of the present invention to provide congruent game board segments on which there are, by printing or the like, pathway designs that may be different for the several segments. However, the entry/exit points of the pathways are all at the same spaced location on all sides of all the geometrically congruent and totally interchangeable game board segments.

A further object of the present invention is to provide pathway designs on each game board segment that complement each other and are in accordance with the particular game and set of rules for which the game board segments are made and with which they are to be used.

A further object of the present invention is to provide the possibility and practicability of butting any side of any one game board segment to any side of any other game board segment, resulting in larger playing areas with more complex overall pathway design.

Even a further object of the present invention is to provide overall game board areas composed of congruent game board segments butted together in seemingly countless random combinations. These result in overall game boards on which the same game and set of rules or different games and sets of rules may be played. The various sets of rules may utilize the congruent nature and total interchangeability of the game board segments.

Further features and objects of the invention will be apparent from an examination of the accompanying drawings which illustrate the invention.

SUMMARY OF THE INVENTION

Accordingly, there is provided a game board composed of nine congruent and totally interchangeable game board segments butted together. The number of game board segments may vary with the particular game and set of rules for which they are designed and with which they are to be used.

In the preferred embodiment of the invention as illustrated in the accompanying drawings, the nine congruent game board segments are butted together in a $3\times3$ configuration. Seemingly countless arrangements of the nine congruent game board segments are possible still resulting in a $3\times3$ configuration. It is also possible to arrange some or all of the nine congruent game board segments into configurations, other than the $3\times3$ one illustrated. Again, a set of rules may stipulate the configuration and/or arrangement of the congruent game board segments that is to be used in playing a particular game.

The overall pathway design of the game board differs with each arrangement and/or overall configuration of the congruent game board segments. The entry/exit points on all sides of all the congruent game board segments are all at the same spaced locations, so that the pathways all join and continue from segment to segment.

The particular pathway design of the present embodiment of the invention illustrated below is a labyrinth network. However, other pathway designs are possible as long as their entry/exit points are all at the same spaced locations on all sides of all the congruent game board segments, and that they fulfill the gaming requirements for which they were designed.

DESCRIPTION OF THE ILLUSTRATED EMBODIMENT

Figure 1:
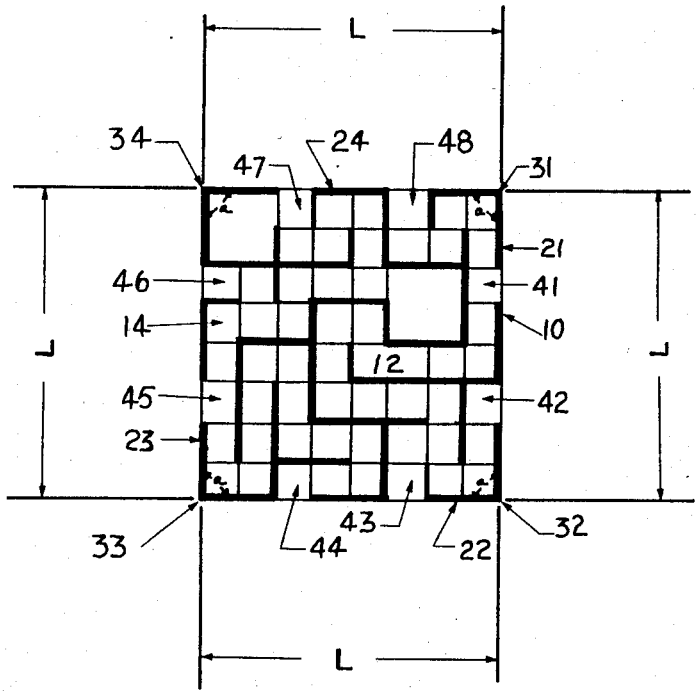
FIG. 1 is a plan view of one particular game board segment.

Referring now to the drawings and in particular to FIG. 1, a particular game board segment 10 made of any suitable material and having a playing surface 12 thereon. The game board segment 10 is a generally square geometric shape, so its four sides 21, 22, 23, 24, are equal in length, L, and its four interior angles 31, 32, 33, 34, are right angles and therefore, equal in arc measurement, a.

The pathway design 14, provided by printing or the like, on the playing surface 12 is such that its entry/exit points 41, 42, 43, 44, 45, 46, 47, 48, are all the third in from each corner of the game board segment 10, and these third spaces are all an equal distance in from each corner of the game board segment 10. The pathway design 14 itself is a labyrinth network.

Figure 2:
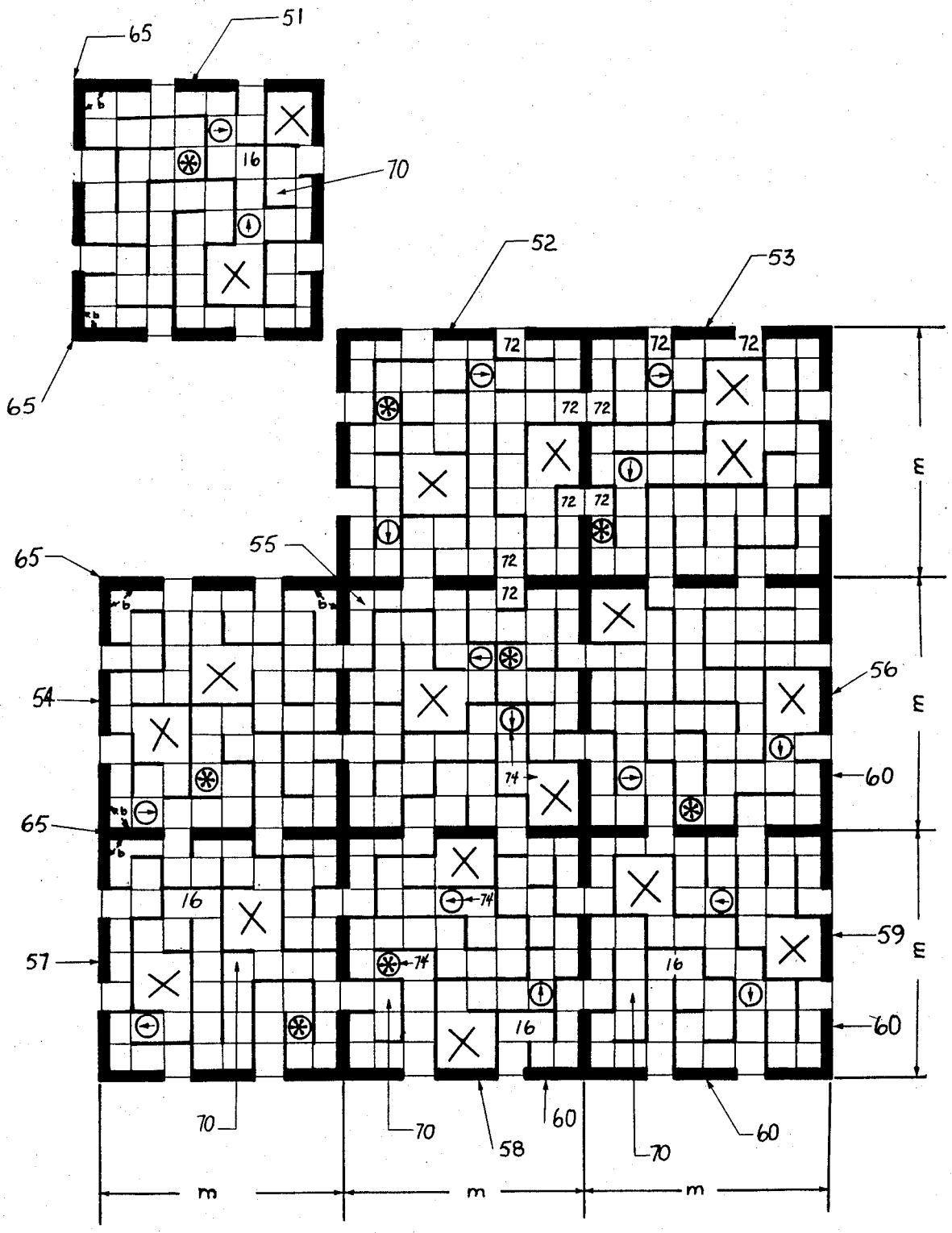
FIG. 2 is a plan view of one possible arrangement of nine congruent and totally interchangeable game board segments butted together in a $3\times3$ configuration.

FIG. 2 illustrates a possible arrangement of nine congruent game board segments 51, 52, 53, 54, 55, 56, 57, 58, 59, in a 3×3 configuration (with game board segment 51 to be butted to segments 52 and 54.) Like the game board segment 10 in FIG. 1, all the congruent game board segments 51, 52, 53, 54, 55, 56, 57, 58, 59, are square. Therefore, all the sides 60 of these congruent game board segments are equal in length, m, and all the interior angles 65 of these congruent game board segments are right angles and so, equal in arc measurement, b. Certain of the game board segments contain dead end or cul-de-sac spaces which must be entered and exited at the same point. For example, note the enlarged space marked "X" to which the lead line of numeral 58 is directed in FIG. 2; also note that enlarged space marked "X" which is the next one vertically above the space having the lead line of numeral 58.

The pathway designs 70 on the playing surfaces 16 of the game board segments 51, 52, 53, 54, 55, 56, 57, 58, 59, are different for the various segments. However, their entry/exit points 72 are all an equal distance in from each corner of each congruent game board segment. The pathway designs thereby continue from one congruent game board segment onto the next, where an entry/exit point 72 of one game board segment meets an entry/exit point of another game board segment. The entry/exit points of all the congruent game board segments meet no matter in which arrangement the congruent game board segments are butted together. Therefore, these congruent game board segments are totally and completely interchangeable, regardless of their orientation—any side of any one comgruent game board segment may be butted to any side of any other congruent game board segment. Any and all arrangements, configurations, and/or orientations of the butted-together congruent game board segments result in overall game boards, each with a network of pathways that continue throughout all of the various congruent game board segments.

On the playing surfaces 16 of the congruent game board segments 51, 52, 53, 54, 55, 56, 57, 58, 59, along with the pathway designs 70, there may be symbols and other indicia 74, that relate to the particular game and set of rules for which the congruent game board segments were designed. These symbols and other indicia may relate to rules that utilize the congruent nature and total interchangeability of the game board segments. Such rules could allow players to randomly butt together or unbutt various game board segments either during the outset of the game or during the actual play of the game, or they could permit players to interchange or switch one game board segment with another, or they could instruct players to eliminate a particular game board segment from the play of the game. There could be many other possible and practical rules relating to the congruent nature and total interchangeability of the game board segments, and these may necessitate players to establish strategies in order to deal with such rules as well as all the other rules of a particular game.

Figure 3:
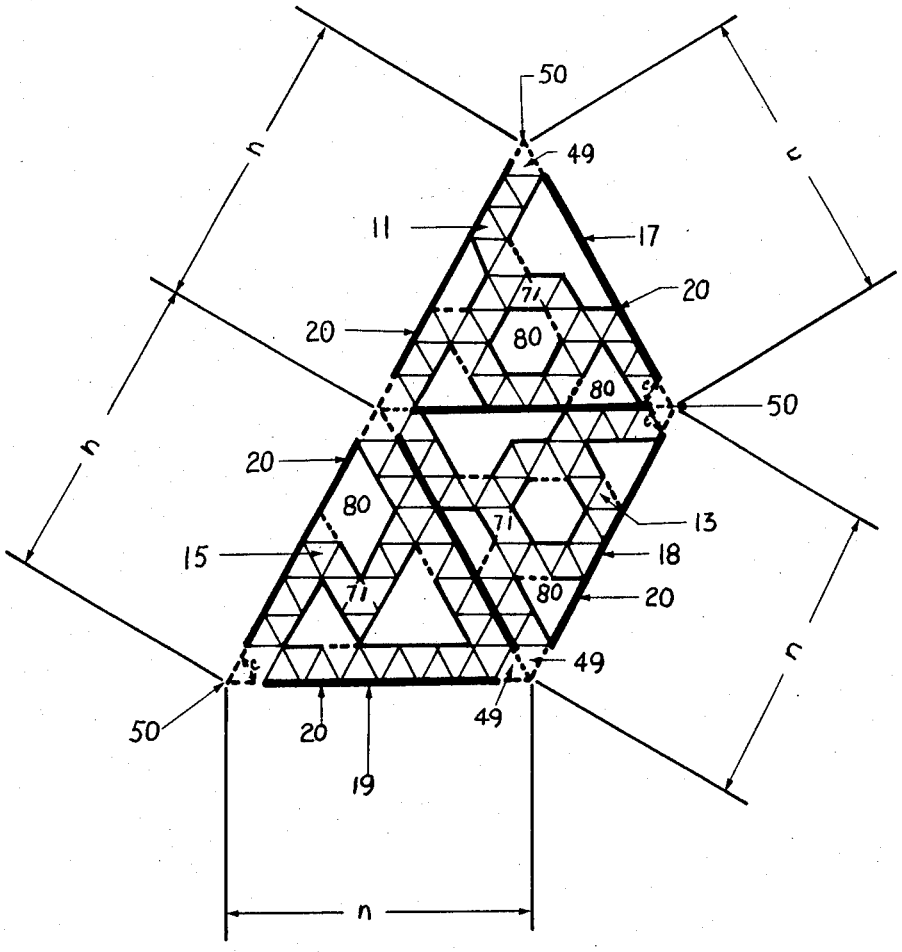
FIG. 3 is a plan view of one possible arrangement of these equilateral triangular congruent game board segments.

FIG. 3 illustrates a possible arrangement of three equilateral triangular congruent game board segments 17, 18, 19, and because these segments are equilateral triangles, all of their sides 20 are equal in length, n, and all of their interior angles 50 are equal in arc measurement, c.

The pathway designs 11, 13, on the playing surfaces 71 of the congruent game board segments 17, 18, respectively, are identical, but they are different than the pathway design 15 on the playing surface 71 of the game board segment 19. The overall pathway design is unique for most of the arrangements of the butted-together game board segments 17, 18, 19, but because the pathway designs 11, 13, are identical, there will be a certain number of arrangements that result in duplications of the overall pathway design. The uniform randomness of the overall pathway design is limited as well, because whole segments of the overall design are repeated. However, games utilizing congruent game board segments may require some or all pathway designs of a particular set of congruent game board segments to be the same and incorporate this aspect of the game board into their strategies.

The entry/exit points 49 are all at the vertices of the triangular game board segments 17, 18, 19. The pathway designs thereby continue from one game board segment onto the next, where the vertices of the triangles meet, and these vertices align regardless of the arrangement, configuration, and/or orientation of the butted-together game board segments 17, 18, 19.

On the playing surfaces 71 of the congruent game board segments 17, 18, 19, in conjunction with the pathway designs 11, 13, 15, there may be areas 80 that relate to the particular game and set of rules for which the congruent game board segments were designed. These areas could serve a wide range of purposes, such as starting or destination spaces. Their specific purpose is established by the particular game and set of rules.

Figure 4:
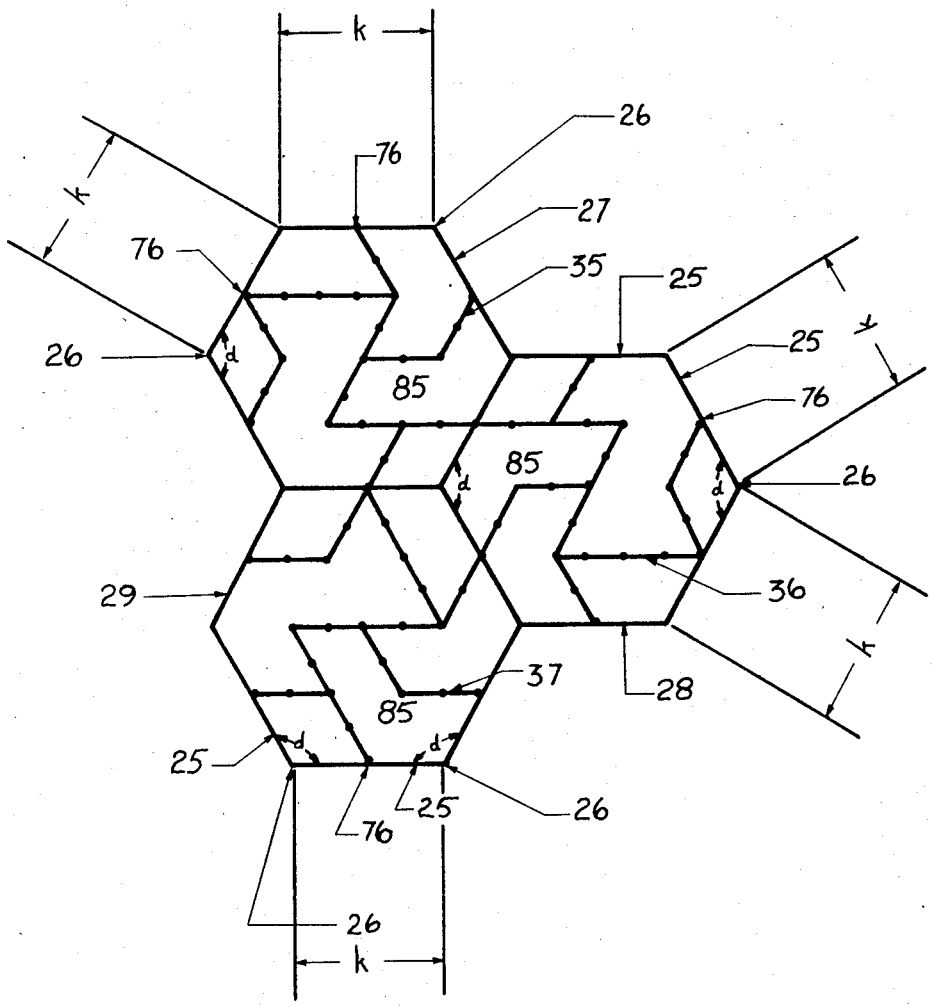
FIG. 4 is a plan view of one possible arrangement of three regular hexagonal congruent game board segments.

FIG. 4 illustrates a possible arrangement of three regular hexagonal congruent game board segments 27, 28, 29, and because these segments are regular hexagons, all of their sides 25 are equal in length, k, and all of their interior angles 26 are equal in arc measurement, d.

The pathway designs 35, 36, 37, on the playing surfaces 85, of the congruent game board segments 27, 28, 29, respectively, are identical. This reduces the number of arrangements of butted-together game board segments that result in an overall game board with a unique pathway design. Even so, there will be many arrangements that do result in unique pathway designs. The uniform randomness of the overall pathway design is also greatly reduced, because the same segment of pathway design is repeated again and again. A game may choose to limit these aspects of its game board and incorporate them into its mode of play.

The entry/exit points 76, of the congruent game board segments 27, 28, 29, are all at the midpoint of all the sides of all the game boards segments. The pathway designs thereby continue from one game board segment onto the next, where the midpoints of the sides align. These midpoints align regardless of the arrangement, configuration, and/or orientation of the butted-together congruent game board segments 27, 28, 29.

The pathway designs 35, 36, 37, are simple networks of pathways, instead of labyrinths, connecting the several entry/exit points 76. The specific network of pathways, as well as its degree of complexity and detail, is determined by the game and set of rules for which a particular set of game board segments is designed.

The preferred mode of playing using this interchangeable game board invention is one in which players move their various playing pieces or markers a number of spaces determined by a throw of dice or other random chance devices. The playing pieces traverse the game in order to achieve or fulfill the specific goals established by a particular game and set of rules. These sets of rules may permit various game board segments to be moved, switched, or eliminated whenever players roll certain numbers on the dice, land on specific spaces, or accomplish other prescribed conditions. The versatility of these congruent interchangeable game board segments may add many new dimensions to board game playing and intrigue.

Although an illustrative embodiment of the present invention is presented here with reference to the accompanying drawings, it is to be understood that the invention is not limited to this precise embodiment, and that changes and modifications may be effected therein by one skilled in the art without departing from the scope or spirit of the invention.

What is claimed is:

1. A game board comprising a plurality of incremental interchangeable game board segments, each of said game board segments having a plurality of sides and being identically shaped in the form of an equilateral geometric figure;

each of said game board segments further comprising a surface having depicted thereon entry and exit point locations, each of said sides having an equal number of entry and exit point locations, said entry and exit point locations being equally positioned on said sides such that where a game segment is oriented at (360/n)° increments, when n is the number of sides of said game board segment, the entry and exit point locations of each side of said game board segment mate with the entry and exit point locations of an adjacent game board segment;

each of said surfaces further having depicted thereon a labyrinth pathway design whereby the pathway design is a network of individual pathways and every entry and exit point location of a game board segment is connected by a pathway to at least one other distinctly different entry and exit point location on said game board segment;

at least one of said labyrinth pathway designs further including at least one cul-de-sac pathway branching off from a pathway, said cul-de-sac pathway comprising an entry and exit point location adjacent said pathway such that said pathway has access to said cul-de-sac pathway, said cul-de-sac pathway not being connected to at least one other different entry and exit point location.

2. A game board according to claim 1, wherein said game board segments are squares.

3. A game board according to claim 1, wherein said game board segments are equilateral triangles.

4. A game board according to claim 1, wherein said game board segments sre regular hexagons.

5. A game board according to claim 1, wherein said labyrinth pathway design has one or more discrete entry and exit points on each side of the game board segments.

6. A game board according to claim 1, wherein said pathway design is a network connecting the one or more discrete entry and exit points on each side of the game board segments.

7. A game board according to claim 1, wherein said game board segments further includes indicia along the pathway design to indicate special instructions.

8. A game board according to claim 1, wherein said game board segments further includes areas associated with the pathway design as starting or destination spaces.

9. A game board according to claim 1, wherein said surfaces of said game board segments all having depicted thereon one common labyrinth pathway design.

10. A game board according to claim 1, wherein there are two or more different labyrinth pathway designs and each of said surfaces of said game board segments has depicted thereon a labyrinth pathway design.

11. A game board according to claim 1, wherein all of said surfaces of said game board segments have depicted thereon a different labyrinth pathway design such that no two game board segments have identical labyrinth pathway designs.

* * * * *